US009528739B2

(12) United States Patent
Quee

(10) Patent No.: US 9,528,739 B2
(45) Date of Patent: Dec. 27, 2016

(54) ILLUMINATED ARTIFICIAL SNOWMAKING METHOD AND APPARATUS

(76) Inventor: John Alistair Quee, North Vancouver (CA)

( * ) Notice: Subject to any disclaimer, the term of this patent is extended or adjusted under 35 U.S.C. 154(b) by 0 days.

(21) Appl. No.: 14/003,723

(22) PCT Filed: Mar. 9, 2012

(86) PCT No.: PCT/CA2012/000222
§ 371 (c)(1),
(2), (4) Date: Dec. 30, 2013

(87) PCT Pub. No.: WO2012/119240
PCT Pub. Date: Sep. 13, 2012

(65) Prior Publication Data
US 2014/0124592 A1 May 8, 2014

Related U.S. Application Data

(60) Provisional application No. 61/450,976, filed on Mar. 9, 2011.

(51) Int. Cl.
*F25C 3/04* (2006.01)
*A63J 5/02* (2006.01)

(52) U.S. Cl.
CPC . *F25C 3/04* (2013.01); *A63J 5/028* (2013.01)

(58) Field of Classification Search
USPC ..... 239/14.2
See application file for complete search history.

(56) References Cited

U.S. PATENT DOCUMENTS 3,415,512 A * 12/1968 Burnbaum ..... A47G 33/0845 239/14.2
6,939,465 B2 * 9/2005 Dupre ..... B01D 35/02 210/248

(Continued)

FOREIGN PATENT DOCUMENTS

CN 2602265 Y 2/2004
CN 201093455 Y 7/2008

(Continued)

OTHER PUBLICATIONS

FG-100 Evaporative Snow FAQ http://globalspecialeffects.com/faqsnow.aspx#es1.*

(Continued)

*Primary Examiner* — Arthur O Hall
*Assistant Examiner* — Adam J Rogers
(74) *Attorney, Agent, or Firm* — Fenwick & West LLP

(57) ABSTRACT

An apparatus for making artificial snow comprises: a) a reservoir for an evaporative snow solution; b) a fluid line with an upper end and a lower end; c) a pump to deliver the evaporative snow solution through the fluid line to a fan at or near the upper end of the fluid line; d) a sock; e) an illuminating means which is configured to illuminate the artificial snow once produced and falling; and f) a ventilated protective membrane around the illuminating means to prevent ingress of fluid; wherein the entire apparatus is contained within the body of a decorative device, and wherein the sock is disposed at or near an upper area of said device, and wherein the fan is capable of blowing the evaporative solution from the upper end of the fluid line through the fabric of the sock so as to create a foam-like snow.

12 Claims, 4 Drawing Sheets

(56) References Cited

U.S. PATENT DOCUMENTS

| | | | | |
|---|---|---|---|---|
| 2002/0033022 | A1* | 3/2002 | Guerra | 62/74 |
| 2004/0012961 | A1* | 1/2004 | Wong | 362/249 |
| 2004/0050949 | A1* | 3/2004 | Duper | F25C 3/04 239/14.2 |
| 2008/0210772 | A1* | 9/2008 | Pearce et al. | 239/67 |

FOREIGN PATENT DOCUMENTS

| | | | |
|---|---|---|---|
| CN | 101551084 | A * | 10/2009 |
| CN | 102072444 | A | 5/2011 |

OTHER PUBLICATIONS

FG-50 Evaporative Snow MSDS http://docs.globalspecialeffects.com/snow/msds/fg-50.pdf.*
Machine Translation of CN 101551084 A.*
PCT International Search Report and Written Opinion for PCT/CA2012/000222, Jun. 19, 2012, 8 pages.

* cited by examiner

ILLUMINATED ARTIFICIAL SNOWMAKING METHOD AND APPARATUS

FIELD OF THE INVENTION

The present invention relates to the field of special effects, artificial snowmaking and apparatus therefor.

BACKGROUND OF THE INVENTION

It is often desired to have the effect of falling snow as a decorative feature for seasonal celebrations and events and general enjoyment. Based on years of innovation, there are numerous ways to produce both "real" snow and "artificial" snow products. These techniques have varying degrees of complexity and equipment required. As such, costs for acquiring and using such equipment varies significantly.

One reasonably priced and accessible technology involves the use of "evaporative snow". This generally involves a technique in which a pre-formulated foam-based solution (primarily surfactants, alcohol and water) is agitated through a water pump and a fabric mesh material to make a very realistic "fake" snow product. As the water begins to evaporate, the flakes become smaller and lighter until they disappear.

The starting snow solution and techniques for making evaporative snow are both well known in the art and the solution and machines commercially available from a number of companies. However, innovation relating to the new, fun and creative means by which evaporative snow is delivered is desired.

It is an object of the present invention to provide such a means.

SUMMARY OF THE INVENTION

The present invention provides an apparatus for making artificial snow which comprises: a) a reservoir for an evaporative snow solution; b) a fluid line with an upper end and a lower end; c) a pump to deliver the evaporative snow solution through the fluid line to a fan; d) a sock; e) an illuminating means which is configured to illuminate the artificial snow once produced and falling; and f) a ventilated protective membrane around the illuminating means to prevent ingress of fluid; wherein the entire apparatus is contained within the body of a decorative device, and wherein the sock is disposed at, near or above an uppermost surface of said device, and wherein the fan is capable of blowing the evaporative solution from the upper end of the fluid line through fabric of the sock so as to create a foam-like snow.

The present invention further comprises the device, so formed.

The present invention further provides a decorative device in which the apparatus is enclosed, or situated or contained, fully or partially.

The present invention further comprises methods of making artificial snow using such an apparatus, with such a device.

The apparatus and device of the present invention together provide a novelty product in the artificial snow manufacturing space which can be used for the production of such snow in any environment, both residential and commercial. Importantly, the artificial snow-making components are substantially completely contained in a novelty housing or device such that there is no unsightly box-like machine in clear view which destroys the illusion of "real" snow falling. Further, by way of the illuminating means, the artificial snow is illuminated. As such, when the artificial snow is being produced in the dark, a completely natural effect is created whereby a viewer perceives the snow as swirling in the sky around or falling adjacent to the device. The device is intended to provide a whimsical, fun means to produce and deliver evaporative snow.

BRIEF DESCRIPTION OF THE FIGURES

The following figures set forth embodiments of the invention in which like reference numerals denote like parts. Embodiments of the invention are illustrated by way of example and not by way of limitation in the accompanying figures and description of the preferred embodiments which follow.

PREFERRED EMBODIMENTS OF THE INVENTION

Figure 1:
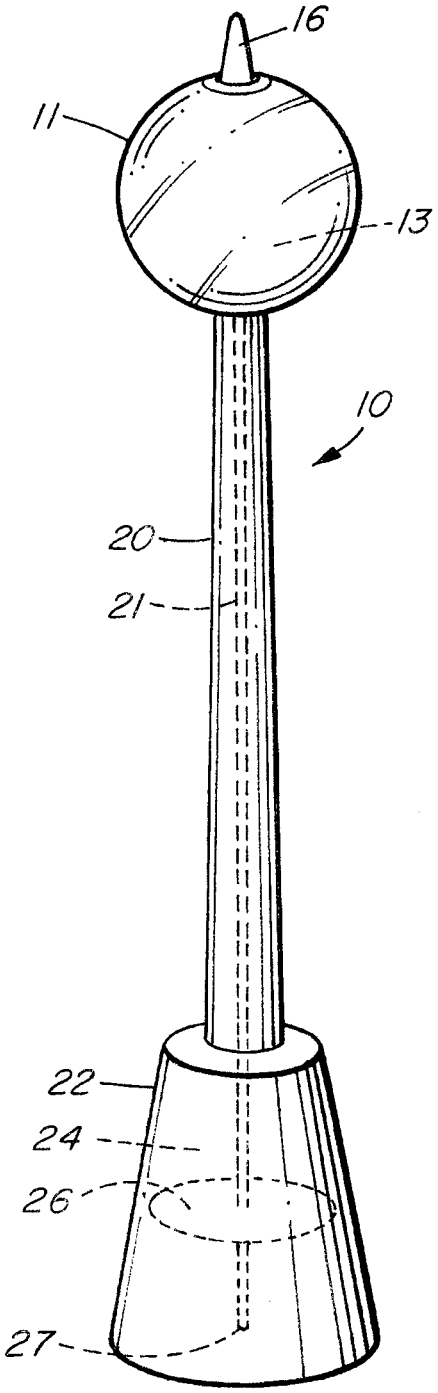
FIG. 1 is a perspective view of a configuration of the device of the present invention, wherein device is a lamppost shown in the form of a globe light and wherein portions of the globe lamp are depicted in partial cut-away to show inner components.

A detailed description of one or more embodiments of the invention is provided below along with accompanying figures that illustrate the principles of the invention. The invention is described in connection with such embodiments, but the invention is not limited to any embodiment. The scope of the invention is limited only by the claims and the invention encompasses numerous alternatives, modifications and equivalents. Numerous specific details are set forth in the following description in order to provide a thorough understanding of the invention. These details are provided for the purpose of example and the invention may be practiced according to the claims without some or all of these specific details. For the purpose of clarity, technical material that is known in the technical fields related to the invention has not been described in detail so that the invention is not unnecessarily obscured.

In other words, the invention is described in connection with such embodiments, but the invention is not limited to any embodiment. The scope of the invention is limited only by the claims and the invention encompasses numerous alternatives, modifications and equivalents. Numerous specific details are set forth in the following description in order to provide a thorough understanding of the invention. These details are provided for the purpose of example and the invention may be practiced according to the claims without some or all of these specific details. For the purpose of clarity, technical material that is known in the technical fields related to the invention has not been described in detail so that the invention is not unnecessarily obscured. Similar reference characters denote similar elements throughout various views depicted in the figures. In the present disclosure and claims, the word "comprising" and its derivatives including "comprises" and "comprise" include each of the stated integers but does not exclude the inclusion of one or more further integers or elements.

The core of the present invention is an illuminated apparatus for producing artificial snow from an evaporative snow solution which is substantially entirely contained in a decorative device.

The decorative device of the present invention comprises components for the production of evaporative snow. The term "apparatus" as used herein, refer to the collection of those components, dispersed within the decorative device. Such components are well known in the art to a skilled person. One aspect of what is unique and inventive in accordance with the present invention, however, is the unique arrangement of these components within the body of a decorative device.

More preferably, the arrangement is such that the efflux of artificial snow is blown from and extends vertically from, at, near or adjacent to the top or upper area of the decorative device. There is a specific advantage to and reason for this: when the evaporative snow egresses upward or outward from a device a dark or near dark condition (regardless of whether inside or outside), the illusion is created that snow is actually falling from the sky with the present arrangement of illumination and evaporative production. In other words, light from the device "catches" the snow as it is falling. It is important to note that evaporative snow dissipates and does not remain on the ground surface. It is not artificial snow per se. As such, creating this illusion while the "snow" is falling is important. The sock is disposed at, near or above an uppermost surface of said device, and the fan blows the evaporative solution from an upper end of the fluid line through fabric of the sock so as to create a foam-like snow. As the snow is blown from an aperture at or near an upper part of the device, it is illuminated as it swirls around and about the device and falls.

The term "sock" as used herein refers to a very fine mesh weave material which engages with the fan, or air produced by the fan. Such a material is well known in the art of evaporative snow-making.

The terms "snow" and "evaporative snow" and "foam-like snow" are used interchangeably herein and refer to the product created as described here from an evaporative snow solution.

In one preferred form, the device is a lamppost. The lamppost, among other styles, can be traditional coach lamp style or globe lamp style. In another preferred form, the device is a blow-molded or injection molded product, more preferably a novelty character. In another preferred form, the device is a novelty character selected from the group consisting of a snowman, an angel, Santa Claus, reindeer, a sleigh, a snow-globe, characters in or parts of a nativity scene, and a train.

The present invention provides an apparatus for making artificial snow which comprises: a) a reservoir for an evaporative snow solution; b) a fluid line; c) a pump to deliver the evaporative snow solution through the fluid line to a fan; d) a fabric sock; e) an illuminating means which is configured to illuminate the artificial snow once produced; and f) a ventilated protective membrane around the illuminating means to prevent ingress of fluid; wherein the entire apparatus is contained within the body of a decorative device, and wherein the sock is disposed at or above an uppermost surface of said device, and wherein the fan is capable of blowing the evaporative solution from an upper end of the fluid line through the fabric of the sock so as to create a foam-like snow.

The evaporative artificial snow-making process is preferably as follows: a snow solution is contained in a reservoir. A small plastic feed line takes the fluid from the reservoir (at lower end of the feed line) to a small fabric sock (adjacent an upper end of the feed line) by means of a pump. The sock is mounted at a position relative to an end of a high output fan or blower. The sock material is a very fine mesh weave and acts like hundreds of very tiny bubble wands, producing clusters of bubbles appearing as "flakes". The "flake" size varies according to the speed of the pump and the amount of fluid reaching the sock. Generally, more fluid results in more and larger clusters of bubbles or "flakes".

Preferably, the snow solution comprises water, one or more surfactants and one or more alcohols. It is preferred to use, in the solution, either distilled or ionized water. There are a number of commercially available solutions on the market, which are fully useable in accordance with the present invention.

It is important to note that the kind of water used will affect the quality of snow. As noted, it is recommended to use water which is distilled or de-ionized water. The latter form of water has no minerals, hard properties or chlorine. De-ionized or distilled water tends to make the best foam and leaves no water stains. It was originally used for the movie industry, so if the snow landed on a camera lens, it would not leave a water ring. Since this formulation has no chemical, it dries and leaves no film. The use of tap water, city water or well water may produce less than ideal results.

In a preferred form, the pump/fan is disposed within an uppermost portion of said device. In a more preferred form, the device is a lamppost and the pump/fan is disposed within its head.

Figure 4:
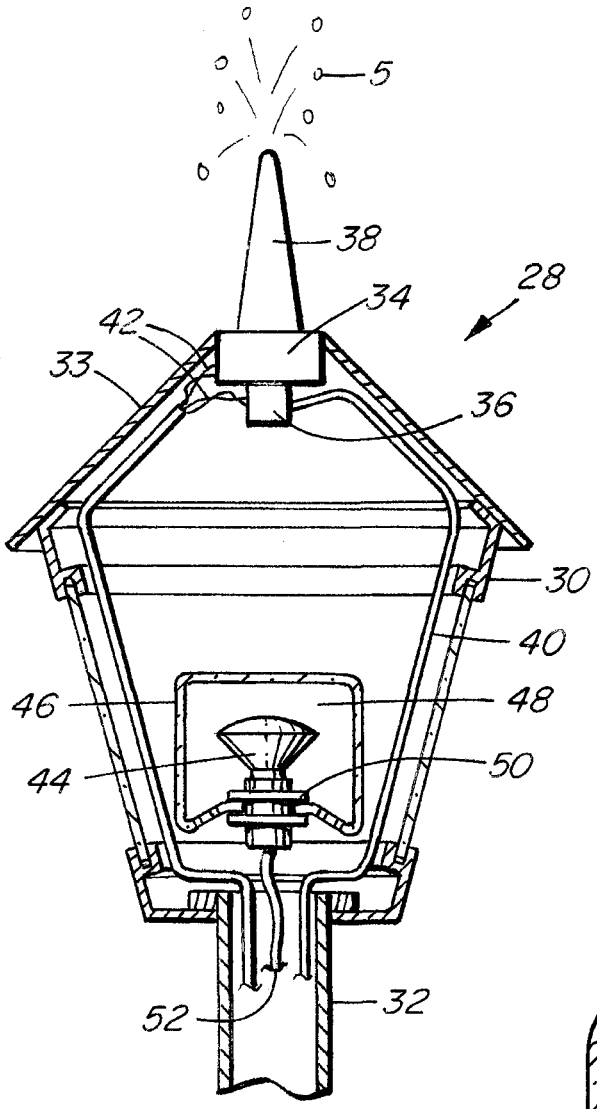
FIG. 4 is side cut-away view of a lamp head comprising parts of the apparatus to i) illuminate and ii) create evaporative snow.
Figure 5:
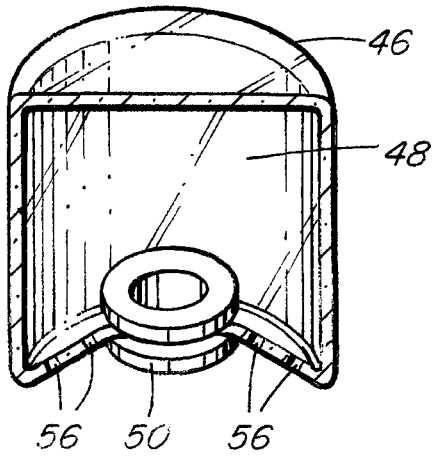
FIG. 5 is a perspective view of a waterproof enclosure and seal to surround a source of illumination within a device.

In a preferred form, an illuminating means within the device is encased within a water-proof housing. In one aspect, this is a ventilated protective membrane around the illuminating means to prevent ingress of fluid. This is illustrated in FIGS. 4 and 5, described further below. The reason for this is simple, feed or fluid lines will carry the evaporative snow solution to an area of the device which is often in close proximity to the illumination means. For safety reasons, and to ensure proper operation of the device, an appropriate degree of containment of any electrical elements and the illumination means is desired.

In operation, and all within the device of the present invention, a snow solution is drawn via a pump into a fluid line at a desired rate, which may be varied to control or limit the size and volume of the flakes produced. The fan blows the evaporative solution from an upper end of the fluid line through the fabric of the fabric sock so as to create a foam-like snow. The artificial snowflake bubbles so formed are projected from the sock generally upwardly above the apparatus by means of airflow produced by the carrier fan. The illuminating means lights the snow surrounding the device to create, when dark, the illusion or naturally blowing or falling snow. As such the snow production and illumination work in tandem to create the required illusion.

In a most preferred form, the apparatus is operated at dark and the artificial snowflake bubbles are ejected from the sock (which is disposed at the uppermost portion of the device) in a substantially vertical manner. While the illumination means can illuminate the entirety of the device to achieve one effect, it can also only illuminate the falling snow adjacent to or around the device (and not the upwardly vertically projected snow), thereby creating the illusion (to the viewer at night) of snow gently falling from the sky as this is all the viewer can see. So, one aspect of the invention is this unique combination of the snowmaking apparatus being configured to be "hidden" within a device (such as a lamppost, novelty figure or the like) and the strategic illumination of the blowing or falling snow, as desired.

It is envisaged in a preferred embodiment, that a consumer may use a series of lampposts (devices) along a driveway, each one comprising the apparatus of this invention. In a most preferred form and regardless of the type of device used, activation of the snow production is triggered at each post by motion sensor. As a traveler reaches each post along the driveway, the motion sensor activates snow production. Such production would continue for a pre-programmed period of time before cessation.

Some previously existing devices may be configured to hold a snowmaking apparatus in accordance with this invention. For example, some existing ornamental lighting or novelty products may be "retrofit" with this apparatus.

The lamppost in a preferred form of the present invention will preferably be comprised of a "knock down" component that includes: a base which will house the artificial snow fluid reservoir, two middle "post" sections that will be assembled to add height to the device, and within which are housed controls. During set up and before operation, the "snow fan" or lamp head will then be attached to the top of the post.

The device in accordance with this invention comprises controls. For example, an on-off switch for the illuminating means, an on-off switch for the evaporative snowmaking apparatus, and variable output controls for the evaporative snowmaking apparatus. The illuminating means is preferably is a cool or low heat light source such as a fluorescent or LED light so as not to overheat the device. There may be separate controls for the illuminating means and the evaporative snowmaking apparatus. The controls for turning both on and off may be operated either manually or remotely, for example by a remote control device engaged with a microprocessor within the apparatus. Such a microprocessor may be engaged remotely via a Wi-Fi or other such connection, allowing a user to activate the illuminating means and the evaporative snowmaking apparatus by way of a remote computer, SmartPhone or tablet.

A power cord and uptake hose or fluid line together run through the apparatus and connect an external AC/DC power source and the snow fluid reservoir with a light socket and the evaporative snow machine device. In some variants, a battery source may also be included within a post and utilized, as a power source Additional design components could include a compartment at the bottom of the base into which water, or sand, can be placed to add weight to the bottom of the device and increase stability. In addition, infra-red sensors or other motion detectors, and a timer, could be added to the device-lamp post so that the falling snow effect would only be activated when one, or one of several, sensor(s) was triggered by an approaching person or vehicle, as noted above.

Figure 1A:
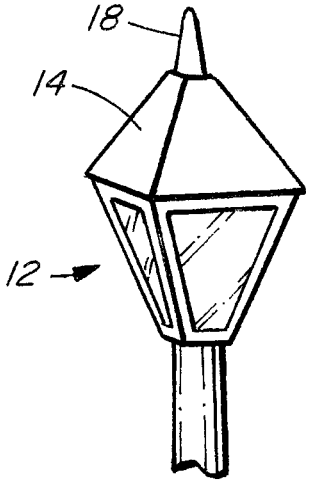
FIG. 1A is second perspective view of a configuration of the device of the present invention, wherein device is a lamppost shown in the form of a traditional coach lamp light.

Turning to the Figures: FIG. 1 depicts at 10 a globe lamppost (with head 11) and at 12 of FIG. 1A, a cut-away of a head 14 of a traditional coach lamppost. Within each head 11 and 14, there is not only provided an illuminating means by also a pump and fan arrangement 13 (either separately, as two different products or as a combination product). Atop head 11 of FIG. 1 is provided snow sock 16 and atop head 14 of FIG. 1A is provided snow sock 18. Within post 20 is provided a feed or fluid line 21. Within base 22 is provided a snow solution reservoir 24, holding snow solution 26.

Figure 2:
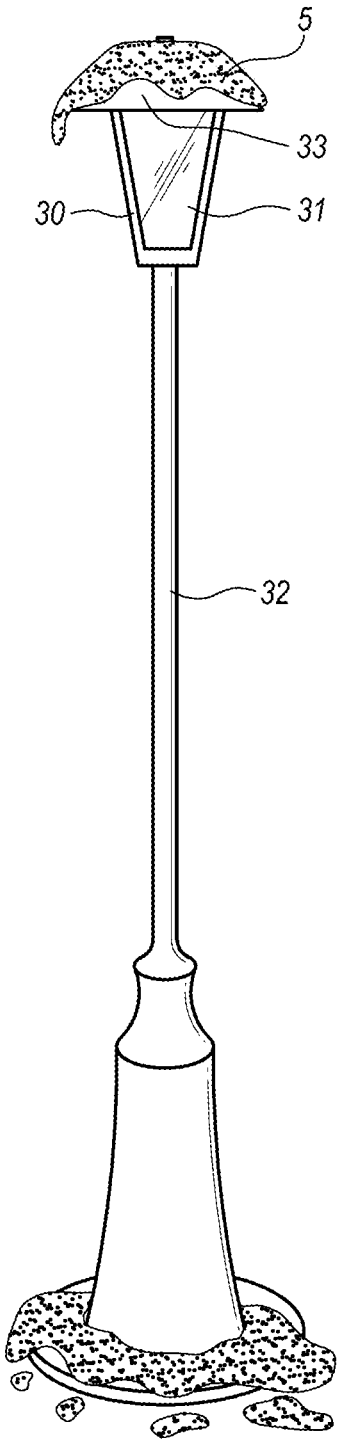
FIG. 2 is a photograph of the device of the present invention, wherein such device is a coach lamppost and the artificial snow is being blown from the top thereof.
Figure 3:
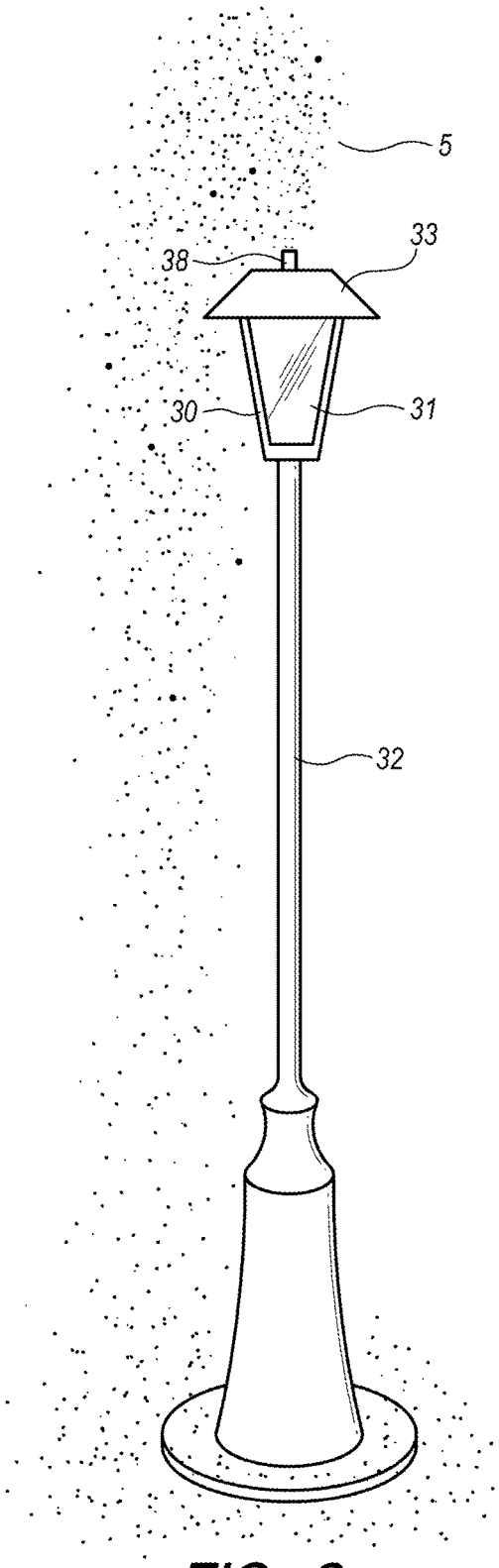
FIG. 3 is a photograph of the device of the present invention, wherein such device is a coach lamppost and the artificial snow is shown resting on the top surface thereof.

FIG. 2 is a photograph of lamp post with head 30 and post 32. Settled on head lamp cap 33 is evaporative snow 5, post-production. Panes 31 are provided within head 30 for the purpose of viewing illumination generated by the light source. Similarly, in FIG. 3, there is provided lamp post with head 30 and post 32. Extending from lamp head cap 33 and more specifically sock 38 is evaporative snow 5, post-production. What is illustrated well in FIG. 3 is a preferred piece in the light/production illusion. It is not desired to direct light on the sock area, and the evaporative snow shooting upwardly therefrom, as this would destroy the illusion of falling snow. As such, it is most preferred that the illumination means not direct light to the sock and point of egress of the evaporative snow from the device.

FIG. 4 is side cut-away view of a lamp head comprising parts of the apparatus to i) illuminate and ii) create evaporative snow. A lamppost (generally at 28) comprises a head 30 and post 32 and lamp head cap 33. Within head 30 is disposed some components of the evaporative snow making apparatus: fan 34, pump 36, sock 38, upper end of fluid line 40, pump and fan electrical cables 42 and illuminating means 44. Base 22, snow solution reservoir 24, holding snow solution 26 and lower end of fluid line (shown as 27 in FIG. 1) are not shown in FIGS. 4 and 5.

What FIG. 4 illustrates well is the means by which fluid lines and electrical elements are separated within head 30, such that the device can be operated safely. Although this device is a lamppost, the principles of snow production and separation of the fluid lines and electrical elements can be easily translated to other decorative devices. Illuminating means 44 is encased with waterproof housing 46

Waterproof housing 46 forms an illumination means protective space 48, into which illumination means 44 may be placed. Housing 46 may be made of any suitable waterproof material but preferably it is a pliable, clear or translucent, plastic or clear or translucent rubber. Housing 46 further comprises a flange seal 50 (preferably made of rubber but other sealing materials would work as well) which lies between a base or socket of the illumination means 54 (for example a lamp base) and protective space 48 to prevent fluid ingress and inadvertent electrical contact with fluid. Power for the illumination means is supplied via power cable 52.

It can be easily seen in FIG. 4 that pump and fan electrical cables 42 and fluid line 40 are separately disposed with head 30 and preferably run along a corner of the head for concealment. It is preferred that waterproof housing 46 comprises some means of ventilation (due to heat generation by illuminating means). One way that this can be accomplished is via small perforations 56 (FIG. 5) in the material of the housing.

FIG. 4 illustrates an embodiment wherein pump 36 is disposed adjacent to fan 34 within the head of the device. This is not a requirement. What is required, however, is that fan 34 be adjacent and in working relations with sock 38 and upper end of fluid line 40.

FIG. 5 is a perspective and more detailed view of a waterproof enclosure and seal to surround a source of illumination within a device. It illustrates perforations 56 in a lower surface 55 of housing 46. This lower surface is preferably not only perforated but of a concave shape (curved inwardly towards protective space 48) therein providing a further means to prevent fluid ingress.

While embodiments of the present invention have been shown and described herein, it will be obvious to those skilled in the art that such embodiments are provided by way of example only. Numerous variations, changes, and substitutions will be obvious to those skilled in the art without departing from the invention. It should be understood that various alternatives to the embodiments of the invention described herein may be employed in practicing the invention. It is intended that the following claims define the scope of the invention and that methods and structures within the scope of these claims and their equivalents be covered thereby.

The invention claimed is:

1. An apparatus for making artificial snow, the apparatus comprising:

a) a reservoir for an evaporative snow solution;

b) a fluid line with an upper end and a lower end;

c) a pump connected to deliver the evaporative snow solution from the reservoir through the fluid line to a fan at or near the upper end of the fluid line;

d) a sock;

e) a head located below the sock, the head comprising:

an electric light source located between a base and a substantially opaque cap;

one or more translucent windows between the base and the cap, the windows surrounding the electric light source such that light emitted by the electric light source issues through the one or more windows to form light beams that project from the one or more windows outwardly from the head; and f) a ventilated protective membrane around the electric light source;

wherein the entire apparatus is contained within the body of a decorative device, and wherein the sock is disposed at or near an upper area of said device, and wherein the fan is arranged to blow the evaporative solution from the upper end of the fluid line through the fabric of the sock so as to create a foam-like artificial snow that leaves the sock in a generally upward direction before falling down past the head through the light beams such that the snow adjacent to and around the head is illuminated by the light beams and the cap substantially blocks the light from illuminating the sock.

2. The apparatus of claim 1 wherein the device is a lamppost.

3. The apparatus of claim 1 wherein the device is a blow-molded or injection molded product.

4. The apparatus of claim 1 wherein the pump and fan are disposed at or near an upper area of said device.

5. The apparatus of claim 1 wherein the device is a lamppost, the head resembles a lamp head, and the pump and fan are disposed within the head.

6. The apparatus of claim 1 wherein the evaporative snow solution comprises water, one or more surfactants and one or more alcohols.

7. The apparatus of claim 1 wherein the water is distilled or ionized water.

8. The apparatus of claim 1 wherein the device additionally comprises a motion sensor which triggers operation of the pump and fan to generate the artificial snow.

9. The apparatus of claim 1 wherein the ventilated protective membrane is a waterproof housing encasing the electric light source and defining a protective space.

10. The apparatus of claim 1 wherein the ventilated protective membrane is a waterproof housing, said housing comprising a lower surface, said surface having at least one perforation.

11. The apparatus of claim 1 wherein the ventilated protective membrane is a waterproof housing, said housing comprising a lower surface, said surface being of a concave shape which is curved inwardly.

12. Apparatus for generating artificial snow, the apparatus comprising:

a head comprising an electric light source located between a base and a substantially opaque cap and one or more windows between the base and the cap, the windows surrounding the electric light source such that light emitted by the electric light source issues through the one or more windows to form light beams that project from the one or more windows outwardly from the head;

an artificial snow maker comprising a sock located above the cap and a fan arranged to blow a snow solution through the sock in a generally upward direction to generate artificial snow that leaves the sock in a generally upward direction before falling down past the head through the light beams such that the snow adjacent to and around the head is illuminated by the light beams and the cap substantially blocks the light from illuminating the sock.

* * * * *